US006155880A

United States Patent [19]

Yu

[11] Patent Number: 6,155,880

[45] Date of Patent: Dec. 5, 2000

[54] WALL-MOUNTED RECEPTACLE ADAPTER

[76] Inventor: Jeff Yu, 2491 Ramke Pl., Santa Clara, Calif. 95050

[21] Appl. No.: 09/307,022

[22] Filed: May 7, 1999

[51] Int. Cl.[7] ..... H01R 25/00; H01R 27/02; H01R 31/00; H01R 33/88; H01R 33/90

[52] U.S. Cl. ..... 439/652; 439/954

[58] Field of Search ..... 439/650, 652, 439/954

[56] References Cited

U.S. PATENT DOCUMENTS

| | | | |
|---|---|---|---|
| 2,488,976 | 11/1949 | Huppert | 439/650 |
| 5,605,466 | 2/1997 | Devlin et al. | 439/144 |
| 5,810,622 | 9/1998 | Chang | 439/622 |

*Primary Examiner*—Lincoln Donovan
*Assistant Examiner*—Brian S. Webb
*Attorney, Agent, or Firm*—R J Services

[57] ABSTRACT

A wall-mounted electrical receptacle adapter is provided and is configured for receiving contact blades of electrical cable plugs. A first adapter surface of the receptacle adapter contains the prong apertures and operatively makes contact with the contact blades of at least one electrical plug. This first adapter surface is disposed slanted downward at an angle relative to the wall side of the receptacle adapter. A second adapter surface disposed below the first adapter surface also being slanted downward at generally the same angle relative to the wall side as the first adapter surface. The slanting angles of the adapter surfaces allow the power cable to naturally and orderly extend downward toward the ground without making sharp angles at the plug end whereby lengthening the operational life of the power cables. In another embodiment, the slanting angles for the two adapter surfaces are different, whose angle measures one being greater than the other.

10 Claims, 3 Drawing Sheets

WALL-MOUNTED RECEPTACLE ADAPTER

TECHNICAL FIELD

The present invention relates to a wall-mounted receptacle adapter. In particular, this invention relates to a wall-mounted adapter having its receptacle surface angled relative to the wall plate.

BACKGROUND ART

Wall-mounted electrical receptacle adapters have long been used for supplying power to the various types of electrical devices, such as refrigerators, fans, electric typewriter, and the like. One issue common to these electrical devices in residential, commercial and industrial environments has to do with the way the device plugs is inserted into the wall outlet receptacles for receiving electrical power. Typically, the power cable and plug extend toward the wall outlet from the backside of an electrical device. The power cable is typically longer than the distance needed for making electrical connection to the wall outlet, and its extra length is usually placed on the floor near the wall outlet receptacle. The power cable plug then rises up from the floor and is inserted into the wall outlet receptacle. The resulting angle formed by the horizontal plug insertion and the nearly vertical cable rising from the floor is sharp and is close to ninety degrees. Often times, the forces exerted on this bent cable by itself, electrical equipment, a computer stand or table would over time cause the cable to be damaged physically and disconnected electrically whereby significantly reducing the operational life of this power cable. The problem is worsened for those power cables having thick and heavy sheathing and insulation where the angle formed as described close to the power plug is made particularly sharp due to the cable stiffness.

Furthermore, an additional factor seems to exacerbate the problem. That is, lack of space. Typical computing equipment users do not leave enough space for the power cables to plug into the wall outlet receptacles. The computer stands or tables are typically pushed as close to the wall as possible whereby they usually apply cable-damaging force to the angled area formed by the horizontal plug insertion and the nearly vertical power cable rising from the floor. More recently, stand-alone peripheral devices have proliferated in the consumer market for computing and communications. For example, they include complex telephone stations, fax/modems, video displays, hard disk drives, tape drives, multimedia kits and the like. They typically have separate power cables requiring additional space near the already-crowded power receptacle area. As many more of these computer-controlled peripheral devices become available to the consumer market, they worsen the lack of space issue, and the cable operational life is further reduced.

Thus, there is a continuing need for an improved wall-mounted electrical receptacle adapter where among others the above-described causes for the reduction of cable operational life would be either removed or greatly alleviated.

SUMMARY OF THE INVENTION

The present invention is a wall-mounted electrical receptacle adapter. This receptacle adapter is configured for receiving multiple electrical plugs each having contact prongs. A first adapter surface of the receptacle adapter contains the prong apertures and operatively makes contact with the electrical plugs. This first adapter surface is disposed slanted downward at an angle relative to the wall side of the receptacle adapter.

In one embodiment, more than one plug receptacle is disposed in a row on the first adapter surface. The receptacle apertures are preferably disposed in the same direction on this first adapter surface for ease of cable management. In another embodiment, a second adapter surface disposed below the first adapter surface also being slanted downward at generally the same angle relative to the wall side as the first adapter surface. In yet another embodiment, the slanting angle for the second adapter surface measures more than that of the first adapter surface.

The slanting angles of the adapter surfaces allow the cable plugs to naturally and orderly extend downward to the ground without making the sharp angles as described whereby lengthening the operational life of the power cables. Further, the same general direction in which the plugged-in cables extend enhances the ease for cable management. For example, they could be easily tied together or channeled into the same protective conduit. Even when pushed against by computer stands and tables, the cables would not be easily damaged. The force components exerted against the cables would be minimal due to the lack of any sharp cable turns which the cable operational life would otherwise be significantly reduced had the adapter surfaces been parallel to the wall plate.

These and features and advantages of the present invention will no doubt become apparent upon a reading of the following description and a study of the several figures of the drawing.

BRIEF DESCRIPTION OF THE DRAWINGS

A better understanding of the present invention can be obtained by considering t he following detailed description taken together with the a accompanying drawings that illustrate preferred embodiments of the present invention in which.

DETAILED DESCRIPTION OF THE PREFERRED EMBODIMENTS

Reference will now be made in detail to the preferred embodiments of the present invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
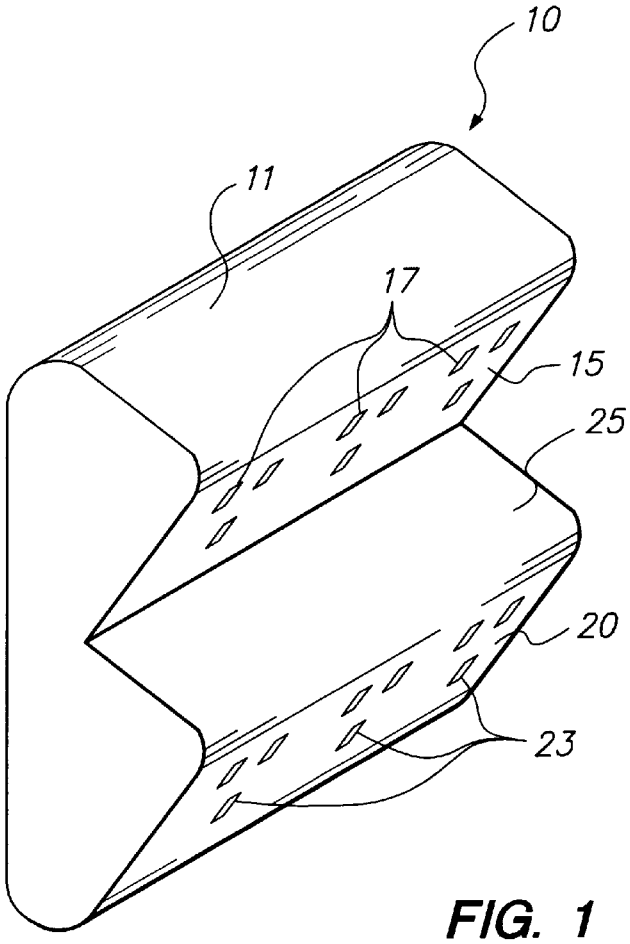
FIG. 1 is a perspective view of a receptacle adapter of the present invention having a first adapter surface and a second adapter surface each making a downward slanting angle relative to the wall side, said slanting angles having generally the same angle measure.

Referring now to FIG. 1, a receptacle adapter 10 embodiment of the present invention is illustrated in a perspective view. The receptacle adapter 10 is provided a front side surface 11, said surface 11 includes a first adapter surface 15 and a second adapter surface 20. Three sets of receptacle apertures 17 are configured uniformly over the first adapter surface 15. Another three sets of receptacle apertures 23 are configured similarly over the second adapter surface 20. The front side surface 11 further includes a plug seating surface 25 that connects the two adapter surfaces 15,20. A preferred embodiment includes rounded edges where possible for better aesthetics; however, the edge between the first adapter surface 15 and the plug seating surface 25 is not rounded for better plug insertion.

Figure 2:
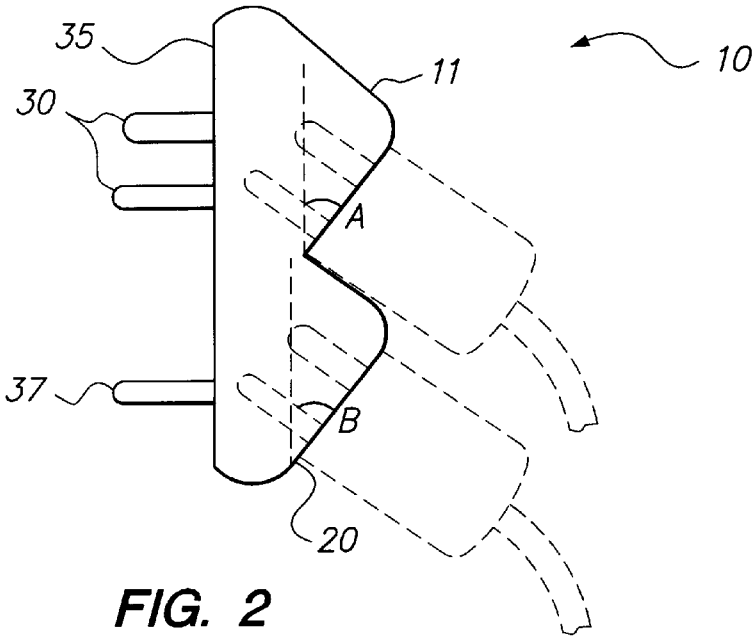
FIG. 2 is a side elevational view of the receptacle adapter of the present invention shown in FIG. 1.

FIG. 2 is a side elevational view for the receptacle adapter embodiment 10. Contact blades 30 include three typical prongs (one prong is not shown) for insertion into a wall outlet (not shown). These contact blades 30 extend from a back side surface 35 of the receptacle adapter 10 to be inserted into a wall outlet receptacle for drawing electrical power from the outlet. The back side surface is configured generally parallel to the wall outlet. A preferred feature may include a support prong 37 that extends from the backside surface 35 and designed to be inserted into a receptacle aperture of the wall outlet receptacle immediately below the wall outlet receptacle receiving the contact blades 30. For example, that aperture may typically be configured to receive the NEUTRAL prong of a power plug.

The first adapter surface 15 and the second adapter surface 20 are configured in a slanted manner relative to the backside surface 35 of the adapter 10. The angle A and angle B are slanting angles made by the two surfaces 15,20 relative to a plane parallel to the backside surface 35, and the two angles have generally the same measures. A preferred angle measure for them is about 50 degrees but a range of angle measures may be adapted for the varying sizes of the electrical plugs. The slanting of the plug insertion not only minimizes damage to power cable but also provides an advantage of space saving behind the electrical and computer equipment especially in view of the ever-increasing consumer appliances and computer peripherals in the market today.

The electrical path and circuitry for passing the power from a wall outlet (not shown) through the receptacle adapter 10 to the inserted the power plugs (two are shown in FIG. 2) is well known by the artisans and therefore it is not illustrated here. Typical additions to the receptacle adapters such as power LED and surge protection circuit may also be included inside the described embodiments. The housing of the receptacle adapter 10 may be of plastics or metal. Any lightweight plastics having adequate heat-resistant or fire-retardant characteristics are preferred.

Figure 3:
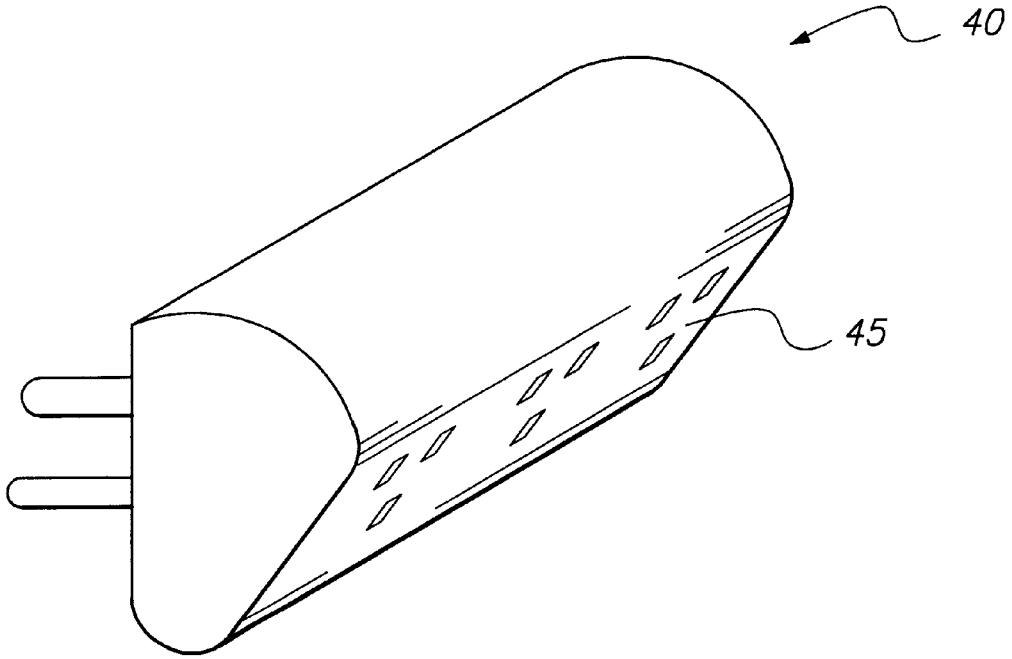
FIG. 3 is a perspective view of an other embodiment of the present invention.
Figure 4:
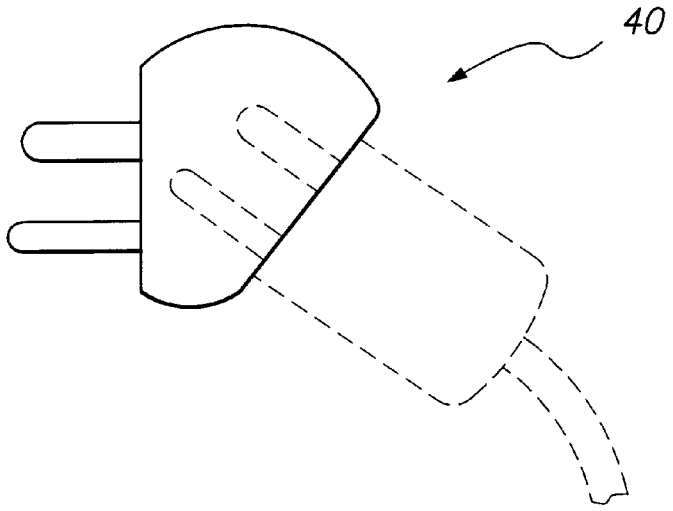
FIG. 4 is a side elevational view of the embodiment shown in FIG. 3.

FIG. 3 and FIG. 4 are perspective and elevational views, respectively, of another receptacle adapter 40 of the present invention. The construct and description for this embodiment 40 are similar to the ones set forth for the receptacle adapter 10 as shown in FIG. 1 and FIG. 2. The difference between the two receptacle adapters 10,40 is in the number of adapter surfaces. The receptacle adapter 40 includes only one adapter surface 45 having at least one set of receptacle apertures for receiving cable plug contact blades (one plug is shown in FIG. 4). On the other hand, the other receptacle adapter 10 has two such adapter surfaces 15,20.

Figure 5:
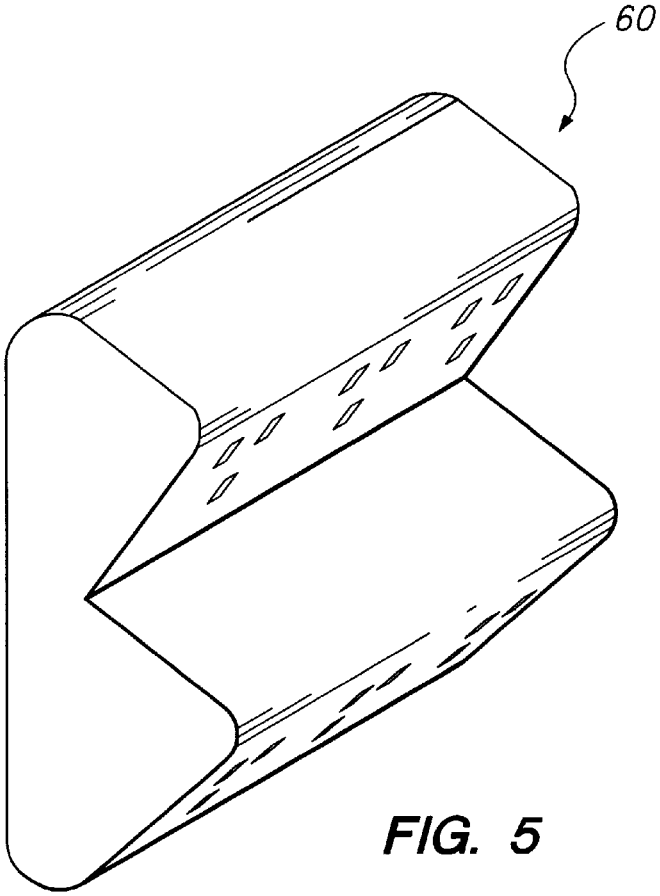
FIG. 5 is a perspective view of yet another embodiment of the present invention, the embodiment having a first adapter surface and a second adapter surface each making a downward slanting angle relative to the wall side, said first adapter surface being disposed above said second adapter surface and said angle of the second adapter surface being slanted more toward the ground than the angle of the first adapter surface.
Figure 6:
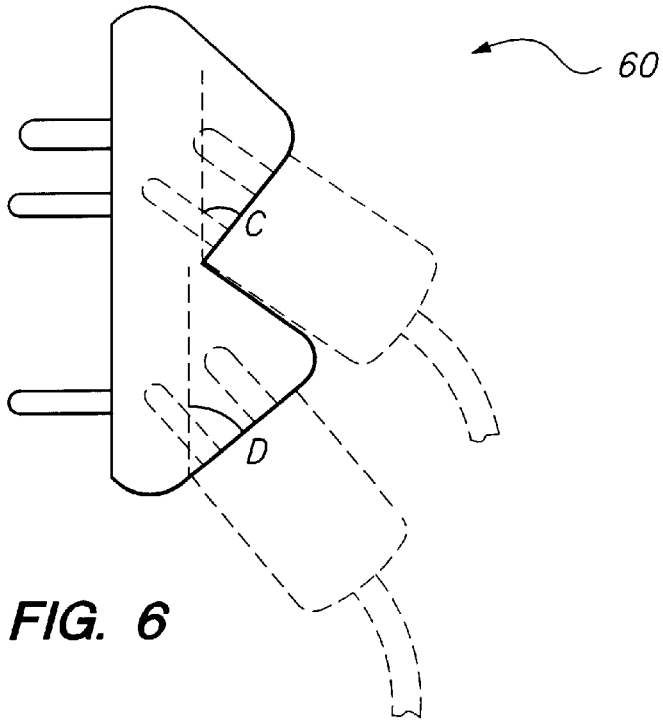
FIG. 6 is a side elevational view of the embodiment shown in FIG. 5.

FIG. 5 and FIG. 6 are also perspective and elevational views, respectively, of another receptacle adapter 60 of the present invention. Again, the construct and description for this embodiment 60 are similar to the ones set forth for the receptacle adapter 10 as shown in FIG. 1 and FIG. 2. However, the slant angle C is generally lesser in its angle measure than that of angle D. A typical difference ranges between 5 to 15 degrees, but the precise advantageous difference between the angles C and D depends on considerations such as cable plug size. Advantageously, this configuration spreads the power cables further apart whereby maximizing the use of available space.

Angles C and D are merely shown to illustrate that the two slanting angles are different from each other. Should the purpose is to channel all inserted power cables into the same protective conduit, angle C may advantageously be greater in angle measure than that of angle D (not shown). In this manner, the resulting cables would be tied or channeled together easier than otherwise.

While the present invention has been described in terms of several preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What I claim is:

1. A receptacle adapter configured for use with a wall outlet having a wall plate generally parallel to the wall, said receptacle adapter comprising:

a back side surface configured generally parallel to the wall plate, said back side surface having a set of contact blades extending therefrom for insertion into said wall outlet, said back side surface further having disposed a support prong extending therefrom for insertion into a receptacle aperture of said wall outlet;

a front side surface including a first adapter surface having at least one set of receptacle apertures adapted to receive contact blades of at least one plug;

said front side surface further including a second adapter surface having at least one set of receptacle apertures adapted to receive contact blades of at least another one plug, said second adapter surface being disposed below said first adapter surface;

said front side surface further including a plug seating surface connecting said first and second adapter surfaces; and said first adapter surface and said second adapter surfaces each forming a slant angle relative to a plane parallel to the back side surface, said slant angle made by said first adapter surface being less than said slant angle made by said second adapter, the difference of angle measuring between said slant angle made by said first adapter surface and said slant angle made by said second adapter surface ranging between 5 to 15 degrees, first adapter surface and said second adapter surface each having three sets of receptacle apertures for receiving contact blades of cable plugs.

2. A receptacle adapter configured for use with a wall outlet having a wall plate generally parallel to the wall, said receptacle adapter comprising:

a back side surface configured generally parallel to the wall plate, said back side surface having a set of contact blades extending therefrom for insertion into said wall outlet;

a front side surface including a first adapter surface having at least one set of receptacle apertures adapted to receive contact blades of at least one plug;

said front side surface further including a second adapter surface having at least one set of receptacle apertures adapted to receive contact blades of at least another one plug, said second adapter surface being disposed below said first adapter surface;

said front side surface further including a plug seating surface connecting said first and second adapter surfaces; and said first adapter surface and said second adapter surfaces each forming a slant angle relative to a plane parallel to the back side surface, said slant angle made by said first adapter surface being less than said slant angle made by said second adapter, the difference of angle measuring between said slant angle made by said first adapter surface and said slant angle made by said second adapter surface ranging between 5 to 15 degrees.

3. The receptacle adapter recited in claim 1 further comprising an electrical surge protection circuitry.

4. The receptacle adapter recited in claim 1 wherein said back side surface further having disposed a support prong extending therefrom for insertion into a receptacle aperture of said wall outlet.

5. The receptacle adapter recited in claim 1 wherein said first adapter surface and said second adapter surface each having three sets of receptacle apertures for receiving contact blades of cable plugs.

6. A receptacle adapter configured for use with a wall outlet having a wall plate generally parallel to the wall, said receptacle adapter comprising:

a back side surface configured generally parallel to the wall plate, said back side surface having a set of contact blades extending therefrom for insertion into said wall outlet;

a front side surface including a first adapter surface having at least one set of receptacle apertures adapted to receive contact blades of at least one plug;

said front side surface further including a second adapter surface having at least one set of receptacle apertures adapted to receive contact blades of at least another one plug, said second adapter surface being disposed below said first adapter surface;

said front side surface further including a plug seating surface connecting said first and second adapter surfaces; and said first adapter surface and said second adapter surfaces each forming a slant angle relative to a plane parallel to the back side surface, said slant angle made by said first adapter surface being greater than said slant angle made by said second adapter surface, the difference of angle measuring between said slant angle made by said first adapter surface and said slant angle made by said second adapter surface ranging between 5 to 15 degrees.

7. The receptacle adapter recited in claim 6 further comprising an electrical surge protection circuitry.

8. The receptacle adapter recited in claim 6 wherein said back side surface further having disposed a support prong extending therefrom for insertion into a receptacle aperture of said wall outlet.

9. The receptacle adapter recited in claim 6 wherein said first adapter surface and said second adapter surface each having three sets of receptacle apertures for receiving contact blades of cable plugs.

10. The receptacle adapter recited in claim 6 further comprising an LED indicator light indicating existence of electrical power and an electrical surge protection circuitry.

* * * * *